US006865280B2

(12) United States Patent
Lin

(10) Patent No.: US 6,865,280 B2
(45) Date of Patent: Mar. 8, 2005

(54) SOCKET FOR A MICROPHONE CONNECTOR

(76) Inventor: Jia-Sheng Lin, P.O. Box 2-10, Tainan City (TW)

( * ) Notice: Subject to any disclaimer, the term of this patent is extended or adjusted under 35 U.S.C. 154(b) by 111 days.

(21) Appl. No.: 10/407,608

(22) Filed: Apr. 1, 2003

(65) Prior Publication Data

US 2004/0197000 A1 Oct. 7, 2004

(51) Int. Cl.[7] ..... H04R 25/00

(52) U.S. Cl. ..... 381/361; 381/369; 381/384

(58) Field of Search ..... 381/369, 170, 381/177, 178, 384, 394, 361, 362, 365, 366, 370, 375; 439/65, 861, 862, 66

(56) References Cited

U.S. PATENT DOCUMENTS 5,109,424 A * 4/1992 Andre et al. ..... 381/384
6,719,568 B2 * 4/2004 Fujimoto et al. ..... 439/65

* cited by examiner

*Primary Examiner*—Huyen D. Le
(74) *Attorney, Agent, or Firm*—J. C. Patents

(57) ABSTRACT

A socket for a microphone connector includes a body, said body having a fixing wall a round front wall formed to extend forward from said fixing wall, an annular wall formed to extend rearward from a rear surface of the fixing wall, plural terminal holes in the center of the body inside the annular wall. Lead terminals respectively have a lead connect end and a pinching end which is formed with two semicircular portions defining a center hollow provided with some elasticity for holding tightly terminals of a microphone connector with a large dimensions so as to keep stably the terminals and better transmitting signals between the socket and the microphone connector.

2 Claims, 4 Drawing Sheets

SOCKET FOR A MICROPHONE CONNECTOR

FIELD OF THE INVENTION

This invention relates to a socket for a microphone connector, particularly to one capable to be inserted by a microphone connector, not only with elastically correcting function in inserting but also with increasing the contact dimensions to obtain extremely good and stable signal transmitting.

BACKGROUND OF THE INVENTION

A conventional socket (A) for a microphone connector shown in FIG. 1 includes a body (A1), an inner circular groove (A10) formed in the body (A1), a front end (A11) formed in the intermediate portion of the inner circular groove (A10), a number of terminal holes (A12) formed in the front end (A11) for a grounding terminal (A2) and two lead terminals (A3) to insert therein. One end of each lead terminal (A3) is a lead connect end (A30) and the other end of the lead terminal (A3) is a forked pinching end (A31) to receive a terminals of a microphone connector. As the pinching end (A31) of the lead terminal (A3) is shaped forked, the terminals of the microphone connector respectively contact with the lead terminals (A3) only at two points when its terminals insert in the lead terminals (A3). As a result, the terminals of the microphone connector may not contact stably with the lead terminals of the socket owing to swaying or being knocked of the socket, and subsequent noise produced in the microphone. In addition, if worse, the microphone connector may separate from the socket to embarrassment of a user.

SUMMARY OF THE INVENTION

The object of the invention is to offer a socket for microphone connector capable to have correcting function of inserting and pulling and provision with lead terminals of a surrounding contact mode to keep the terminals of the microphone connector stabilized in the inserted condition. Then there is no possibility to produce noise to the microphone, with the microphone connector not easily separating from the socket and with extremely good contact of the both.

The invention has the following features.

1. The lead terminals of the socket have at least a pinching terminal formed round-shaped with a hollow interior so as to have elastic function to correct inserting and pulling of the terminals.

2. The hollow portion of the lead terminal is thinner than the rear portion to have excellent elasticity and large dimensions for contacting with the terminals of the connector.

BRIEF DESCRIPTION OF DRAWINGS

This invention will be better understood by referring to the accompanying drawings, wherein.

DETAILED DESCRIPTION OF THE INVENTION

Figure 1:
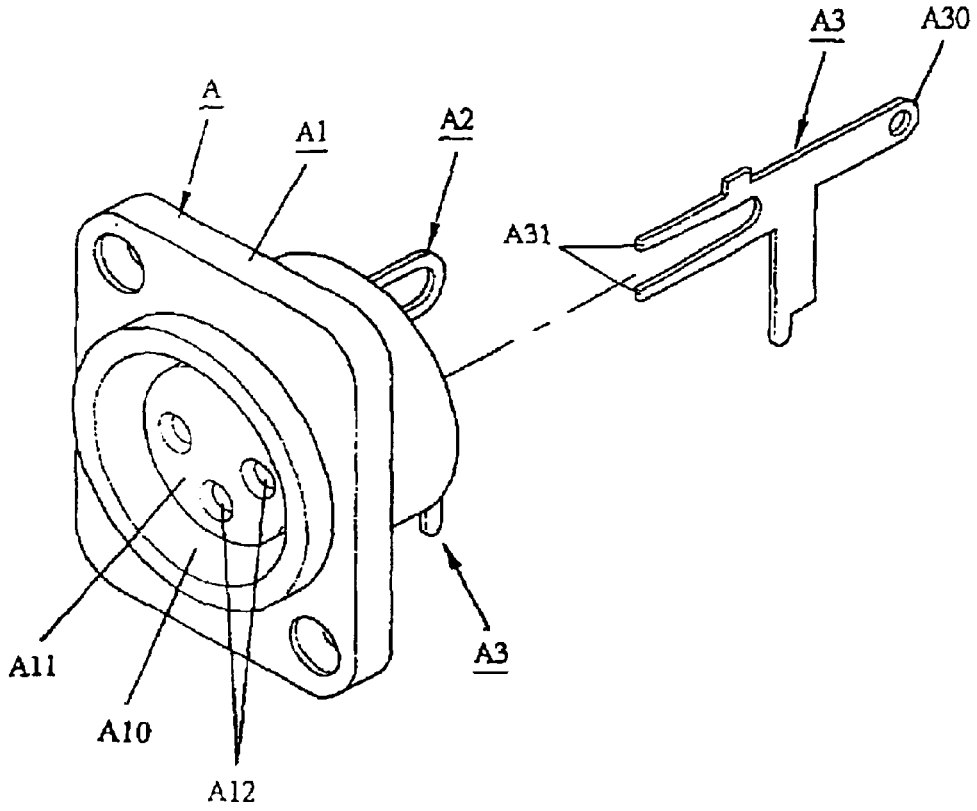
FIG 1 (PRIOR ART)
FIG. 1 is an exploded perspective view of a conventional socket for a microphone connector.
Figure 2:
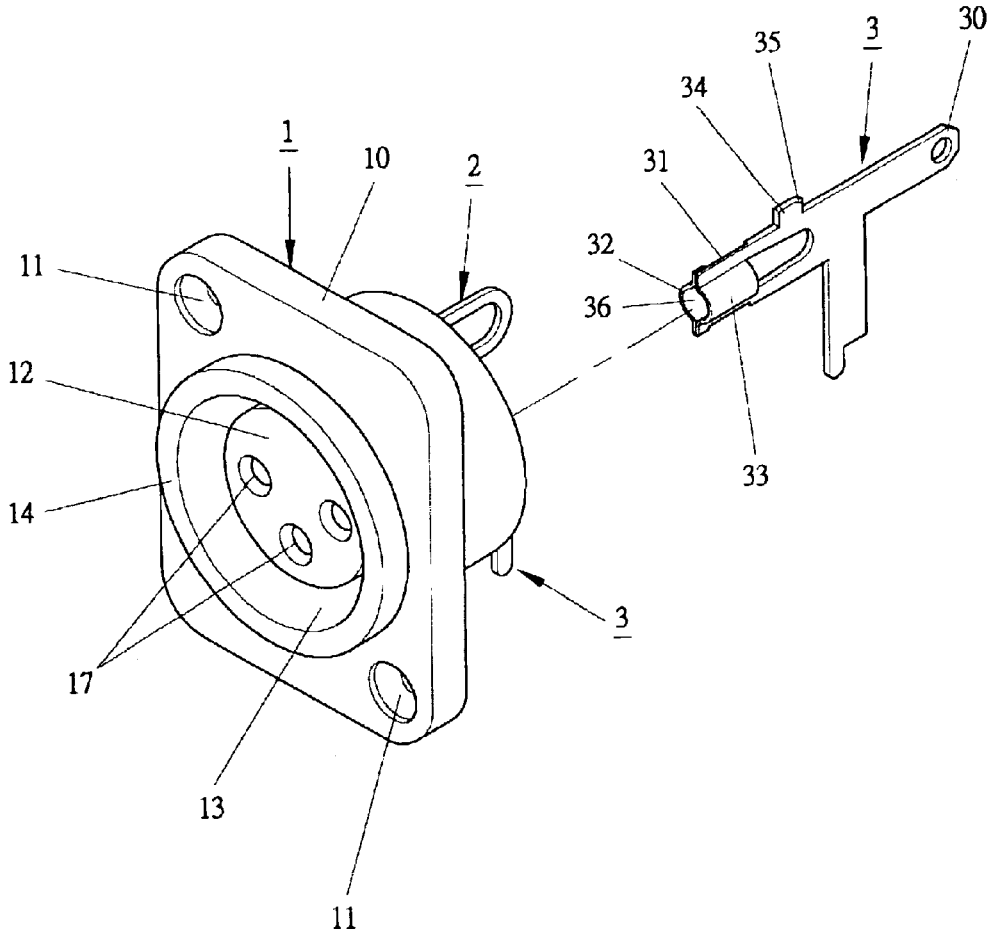
FIG. 2 is an exploded perspective view of a socket for a microphone connector in the present invention.
Figure 3:
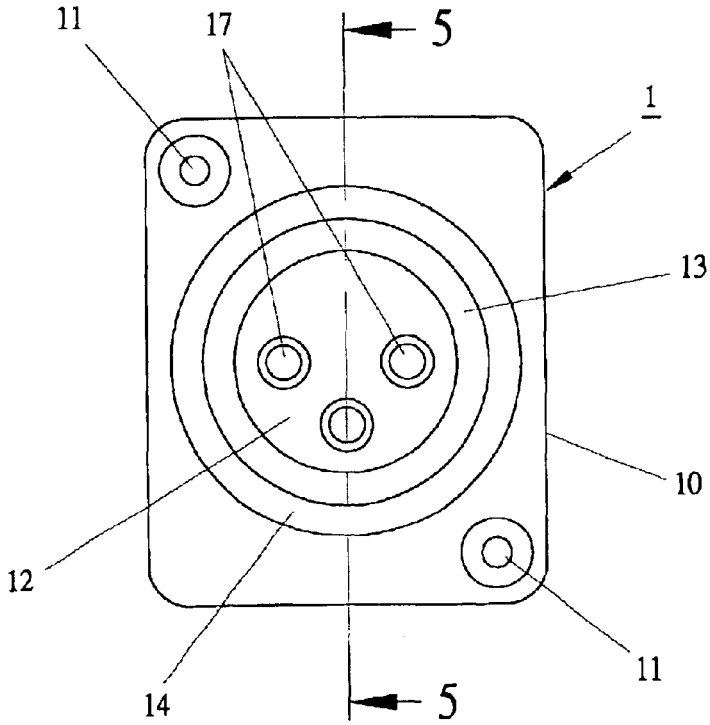
FIG. 3 is a front view of the socket for a microphone connector in the present invention.
Figure 4:
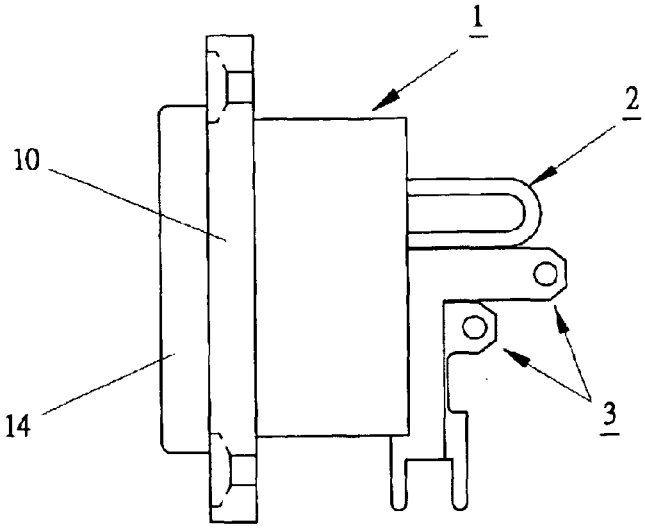
FIG. 4 is a side view of the socket for a microphone connector in the present invention.
Figure 5:
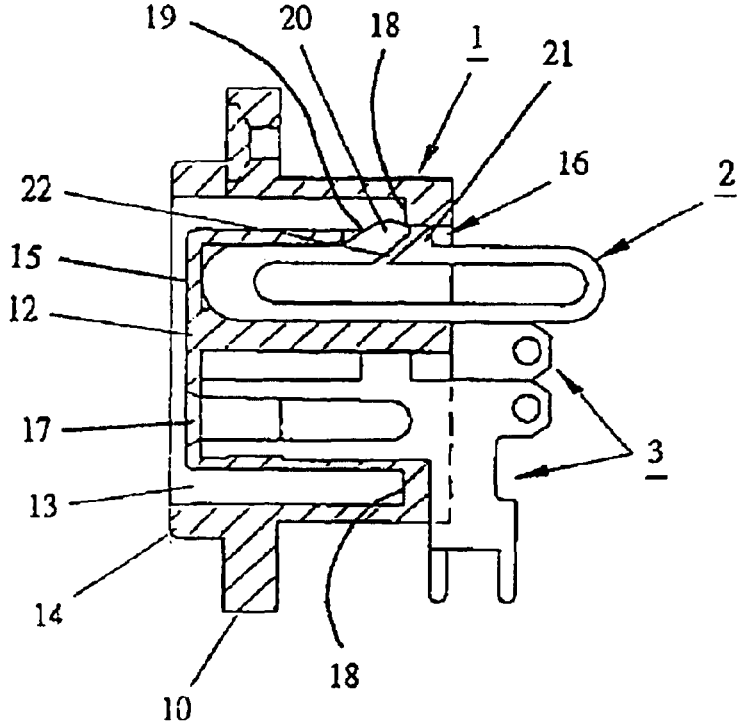
FIG. 5 is a cross-sectional view of the socket for a microphone connector in the present invention; and, FIG. 6 is a perspective view of a lead terminal in the present invention.

A preferred embodiment of a socket for a microphone connector in the present invention, as shown in FIGS. 2 and 3, includes a body 1, a comparatively large fixing wall 10 formed in a front side of the body 1, a number of fixing holes 11 formed in the fixing wall 10 for fixing the socket on a wall or the like. Further, a round front wall 12 is provided to extend forward from the center of the fixing wall 10, and a protruding annular wall 14 defining an inner annular groove 13 is provided on a rear surface of the front wall 12. Further, as shown in FIG. 5, a terminal hole 16 is provided to extend forward from the front surface 15, not going through the front wall 12. Besides, a number of through terminal holes 17 are bored in the front wall 12. The front end of the terminal hole 16 forms an opening 19 at a bottom wall 18 of the inner annular groove 13. Therefore, a grounding terminal 2 and plural lead terminals 3 respectively insert in the terminal hole 16 and the terminal holes 17.

The grounding terminal 2 is shaped as a hollow long round piece, having a large projection 20 and a small projection 21 separated by a gap 22, so the grounding terminal 2 may tightly be kept in the terminal hole 16 by elasticity caused by the two projections 20 and 21 together with the gap 22 after inserted in the hole 16. Further, the large projection 20 protrudes in the opening 19 in the inner annular groove 13 and pushes against the bottom wall 18, as shown in FIG. 5.

Figure 6:
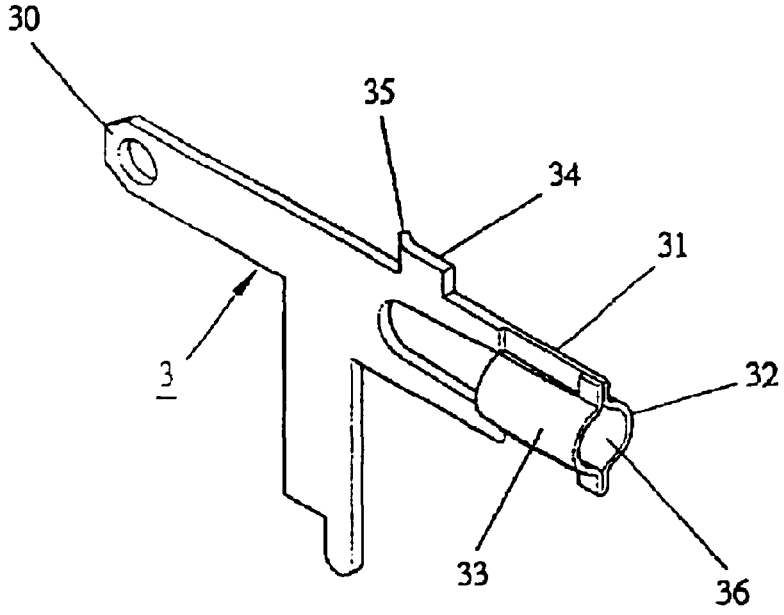

The lead terminals 3 are formed integral, having a lead connect end 30 and a pinching end 31. The pinching end 31 has two semicircular portions 32, 33 made of thin walls to give rise to some elasticity to the lead terminals 3, and a projecting 34 formed on a nearly center portion of an upper side of the lead terminals 3, and a sharp point 35 is formed on an upper end of the projection 34, as shown in FIG. 6. Therefore, when the pinching end 31 of each lead terminal 3 is inserted in the holes 17 of the body, the sharp point 35 tightly pushes the wall of the holes 17, and the circular center hole 36 formed by the two semicircular portions 32, 33 is to be inserted by the terminals of a microphone connector. As the semicircular portions 32, 33 are so thin that both semicircular portions 32 and 33 are provided with proper elasticity to have correcting function for inserting and pulling of the terminals of a microphone connector so as to keep the terminals of the microphone connector stably in the circular center hole 36 of the pinching end 31, and subsequently excellent signal transmission may be obtained between the socket and the microphone connector. The pinching end 31 of the lead terminals 3 has a thickness smaller than that of the lead connect end 30 so as to have excellent elasticity for pinching terminals.

While the preferred embodiment of the invention has been described above, it will be recognized and understood that various modifications may be made therein and the appended claims are intended to cover all such modifications that may fall within the spirit and scope of the invention.

What is claim is:

1. A socket for a microphone connector comprising at least a body, said body having a comparatively large fixing wall, said fixing wall provided with plural fixing holes, a round front wall formed to extend forward from said fixing wall, an annular wall formed to extend rearward from a rear surface of said fixing wall and defining an inner circular groove; a half-through terminal hole extended forward from a front surface of said front wall and not through said front wall for a grounding terminal to fit therein, plural through holes bored in said front wall passing through a rear surface of said front wall for lead terminals to fit therein, said lead terminals respectively having a lead connect end and a pinching end; and, characterized by said pinching end formed by two semi-circular portions to define a tubular center hollow for terminals of the microphone connector to insert therein tightly surrounded by said pinching end, said pinching end having good contact with the terminals of the microphone connector with a function of correcting inserting and pulling of the terminals.

2. The socket for a microphone connector as claimed in claim 1, wherein said pinching end of said lead terminals has a thickness smaller than that of said lead connect end so as to have excellent elasticity for pinching terminals.

* * * * *